US008910782B2

(12) United States Patent
Koster et al.

(10) Patent No.: US 8,910,782 B2
(45) Date of Patent: Dec. 16, 2014

(54) ADHESIVELY JOINED MULTIPACK

(71) Applicant: Focke & Co. (GmbH & Co. KG), Verden (DE)

(72) Inventors: Johann Koster, Verden (DE); Andre Hopf, Mahwah, NJ (US)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 13/765,707

(22) Filed: Feb. 13, 2013

(65) Prior Publication Data

US 2013/0213834 A1 Aug. 22, 2013

(30) Foreign Application Priority Data

Feb. 22, 2012 (DE) ..... 10 2012 101 426

(51) Int. Cl.

| | |
|---|---|
| ***B65D 85/10*** | (2006.01) |
| ***B65D 75/02*** | (2006.01) |
| ***B65B 19/02*** | (2006.01) |
| ***B65B 13/00*** | (2006.01) |
| ***B65B 51/04*** | (2006.01) |
| ***B65B 11/08*** | (2006.01) |

(52) U.S. Cl.

CPC ..... *B65D 75/02* (2013.01); *B65B 19/025* (2013.01); *B65B 13/00* (2013.01); *B65B 51/04* (2013.01); *B65B 11/08* (2013.01); *B65D 85/1072* (2013.01)

USPC ..... 206/256; 206/526

(58) Field of Classification Search

CPC ..... B65D 85/1072; B65D 2203/00; B65D 2203/08

USPC ..... 206/242, 256, 264, 271, 273, 459.5, 206/526, 813; 53/148, 153

See application file for complete search history.

(56) References Cited

U.S. PATENT DOCUMENTS

| | | | | |
|---|---|---|---|---|
| 2,605,897 A | | 8/1952 | Ruhdle | |
| 2,895,272 A | | 7/1959 | Krukonis | |
| 3,027,998 A | * | 4/1962 | Ridgway | 206/264 |
| 3,278,016 A | * | 10/1966 | Conti | 206/271 |

(Continued)

FOREIGN PATENT DOCUMENTS

| | | |
|---|---|---|
| DE | 1213721 A | 3/1966 |
| DE | 4310646 A1 | 10/1994 |

(Continued)

OTHER PUBLICATIONS

German Patent Office, Recherchebericht (Search Report) on related application (Aug. 23, 2012).

*Primary Examiner* — Bryon Gehman

(74) *Attorney, Agent, or Firm* — Laurence P. Colton; Smith Risley Tempel Santos LLC

(57) ABSTRACT

A multipack having a plurality of cuboidal cigarette packs (13), which are partially surrounded by an outer wrapper (14) made of packaging material, the packs (13) being subject, in the region of base side faces (18) thereof, to subsequent application of tax markings (23), and the outer wrapper (14) not extending over the regions of the packs (13) at which the tax markings (23) are to be applied to corresponding faces of the packs (13), that is, not in or substantially not in the region of a base side (19) of the multipack (10), with the outer wrapper (14) being detachably connected to the packs (13) by glue points (31).

10 Claims, 7 Drawing Sheets

(56) References Cited

U.S. PATENT DOCUMENTS

| | | | | |
|---|---|---|---|---|
| 3,596,758 | A * | 8/1971 | Phillips et al. | 206/256 |
| 4,738,359 | A | 4/1988 | Phillips | |
| 4,928,817 | A * | 5/1990 | Focke | 206/256 |
| 4,932,534 | A | 6/1990 | Focke | |
| 5,178,270 | A * | 1/1993 | Adams et al. | 206/256 |
| 5,178,271 | A * | 1/1993 | Adams et al. | 206/256 |
| 5,181,607 | A * | 1/1993 | Focke et al. | 206/273 |
| 5,351,820 | A * | 10/1994 | Focke et al. | 206/273 |
| 6,244,017 | B1 * | 6/2001 | Focke et al. | 53/147 |
| 6,823,989 | B2 * | 11/2004 | Wilder et al. | 206/264 |
| 7,100,764 | B2 * | 9/2006 | Focke | 206/273 |
| 7,234,593 | B2 * | 6/2007 | Fath et al. | 206/264 |
| 2005/0056554 | A1 | 3/2005 | Fath | |
| 2012/0318690 | A1 * | 12/2012 | Buse et al. | 206/256 |

FOREIGN PATENT DOCUMENTS

| | | | |
|---|---|---|---|
| DE | 4440715 | A1 * | 5/1996 |
| DE | 19535649 | A1 | 3/1997 |
| DE | 102010009047 | A1 | 8/2011 |
| GB | 1394532 | A * | 5/1975 |
| GB | 2261648 | A * | 5/1993 |
| GB | 2293338 | A | 3/1996 |

* cited by examiner 21
20
32
33
36
34
35
31
24
25
26

ADHESIVELY JOINED MULTIPACK

STATEMENT OF RELATED APPLICATIONS

This patent application claims the benefit of German Patent Application No. DE 10 2012 101 426.4 having a filing date of 22 Feb. 2012.

BACKGROUND OF THE INVENTION

1. Technical Field

The invention relates to a multipack having a plurality of preferably cuboidal packs, in particular cigarette packs, which are partially surrounded by an outer wrapper made of packaging material, the packs being subject, in particular in the region of base side faces thereof, to subsequent application of tax markings, and the outer wrapper not extending over regions of the packs at which the tax markings are to be applied to corresponding faces of the packs, in particular the base side faces thereof, in particular not in the region of a base side of the multipack or substantially not in said region. The invention further relates to a method and apparatus for handling packaging material for an outer wrapper of a pack, in particular an apparatus for producing a multipack having a plurality of preferably cuboidal packs, which are at least partially surrounded by an outer wrapper made of packaging material.

2. Prior Art

Cigarette packs are combined readily into multipacks for easier handling during transport. Such multipacks made of cigarette packs are also known as cigarette multipacks. The cigarette multipacks can be sold as such or can be broken up by the retailer in order to sell the individual cigarette packs.

In many countries, it is mandatory for tax revenue or customs reasons that tax markings be applied to the cigarette packs. The tax markings can, for example, be in the form of (tax) revenue stamps or (tax) seals. It is also generally mandatory for the tax markings to be connected securely to the cigarette packs in order to prevent misuse.

While in many countries, these tax markings are already applied during the production of the cigarette packs, there are also countries in which the tax markings are only applied at a later point in time. An example that can be mentioned is the USA, in which cigarette packs are taxed differently depending on the state. The tax markings are therefore only applied shortly before the packs are put onto the market in the respective state. It has therefore been usual hitherto to design multipacks containing cigarette packs in such a way that they can be opened for the application of the tax markings and can then be closed again. However, such a procedure is very time-consuming and costly. Alternatively, it is known to leave the multipacks at least partially open in the region of a base side, the base side faces of the packs also being located in said region, so that the base side faces of the packs are free for the application of the tax markings.

BRIEF SUMMARY OF THE INVENTION

On this basis, the object of the present invention is to further develop multipacks of the type mentioned in the introduction, in particular with regard to a cost-effective alternative to known multipacks, which however also enables the application of tax markings to cigarette packs that are in the multipack.

A multipack having a plurality of preferably cuboidal packs, in particular cigarette packs, which are partially surrounded by an outer wrapper made of packaging material, the packs being subject, in particular in the region of base side faces thereof, to subsequent application of tax markings, and the outer wrapper not extending over regions of the packs at which the tax markings are to be applied to corresponding faces of the packs, in particular the base side faces thereof, in particular not in the region of a base side of the multipack or substantially not in said region, characterized in that the outer wrapper is detachably connected to the packs by means of glue portions, in particular glue points is provided in order to achieve this object. According thereto, a particular feature is that the outer wrapper is detachably connected to the packs by means of glue portions, in particular glue points.

The connection between the outer wrapper and the cigarette packs ensures that the cigarette packs are securely received in the outer wrapper following initial use or following removal of one or more cigarette packs.

In a particularly preferred embodiment of the invention, glue portions are applied to the contact points between two adjacent packs. On the one hand, the number of glue points can thus be reduced. On the other hand, the applicant has recognized that this position is particularly advantageous because the packs have greater rigidity or stability in the region of the pack edges than at a distance from the pack edges. This facilitates the pressing of the outer wrapper onto the packs in order to connect said packs. In addition, a connection may also be produced between two adjacent cigarette packs in the same layer if the glue portions are dimensioned accordingly.

The glue points are preferably applied in the vicinity of the open base side of the multipack.

Preferred developments will emerge from the dependant claims and from the rest of the description.

A further multipack for achieving the object mentioned in the introduction is a multipack having a plurality of preferably cuboidal packs, in particular cigarette packs, which are partially surrounded by an outer wrapper made of packaging material, the packs being subject, in particular in the region of base side faces thereof, to subsequent application of tax markings, and the outer wrapper not extending over regions of the packs at which the tax markings are to be applied to corresponding pack faces of the packs, in particular the base side faces thereof, in particular not in the region of a base side of the multipack or substantially not in said region, in particular according to one or more of the preceding claims, characterized in that the outer wrapper is formed from paper or is formed substantially from paper. According thereto, the outer wrapper is made of paper or is made substantially of paper.

The multipack can be produced more cost effectively by the use of paper instead of cardboard. In addition, the use of paper is more environmentally friendly than the use of a plastic film.

It goes without saying that the outer wrapper does not have to consist completely of paper, but may also consist of a paper-based material and/or may have coatings made of other materials.

Preferred developments will emerge from the dependent claims and from the rest of the description.

A further underlying object of the invention is to create suitable apparatuses and methods for producing multipacks of this type. The apparatuses and methods are preferably also to be suitable for use in the production of other packs.

An apparatus for achieving this object is an apparatus for handling packaging material for an outer wrapper of a pack, in particular an apparatus for producing a multipack having a plurality of preferably cuboidal packs, which are at least partially surrounded by an outer wrapper made of packaging material, characterized in that a glue application apparatus for applying glue to the packaging material, in particular a continuous material web or a blank, is provided, and in that the packaging material is guided after the glue application apparatus via a deflecting roller, the deflecting roller having indentations, and the indentations being positioned in accordance with the position of glue portions on the packaging material. According thereto, a glue application apparatus is provided for applying glue to a packaging material and the packaging material is guided via a deflecting roller after the glue application apparatus, wherein the deflecting roller has indentations over its periphery, and wherein the indentations are positioned in accordance with the position of glue portions on the packaging material.

Such an apparatus advantageously enables the use of PSA glues when handling packaging materials. The specific deflecting roller can also be used advantageously with glues that set slowly.

A corresponding handling method is a method for handling packaging material for an outer wrapper of a pack, in particular a method for producing a multipack having a plurality of preferably cuboidal packs, which are at least partially surrounded by an outer wrapper made of packaging material, characterized in that glue is applied by means of a glue application apparatus to a packaging material, in particular a continuous material web or a blank, and is guided after the glue application apparatus via a deflecting roller, the deflecting roller having indentations, and the indentations being positioned in accordance with the position of glue portions on the packaging material.

Preferred developments will emerge from the dependent claims and from the rest of the description.

BRIEF DESCRIPTION OF THE DRAWINGS

A preferred exemplary embodiment of the invention will be described hereinafter on the basis of the drawing, in which.

DETAILED DESCRIPTION OF PREFERRED EMBODIMENTS

The invention will be explained on the basis of a multipack 10 in the form of a cigarette multipack having two rows 11, 12 of cigarette packs 13 arranged one above the other. An outer wrapper 14 holds the cigarette packs 13 in the shape provided. The outer wrapper 14 directly surrounds the group of cigarette packs 13.

Figure 2:
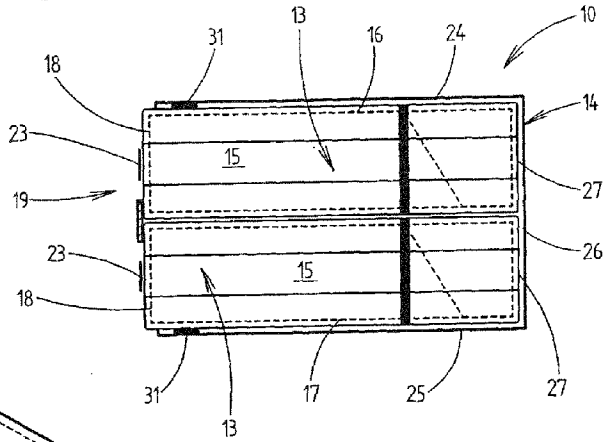
FIG. 2 shows a vertical section through the multipack along the line of section II-II in FIG. 1.
Figure 1:
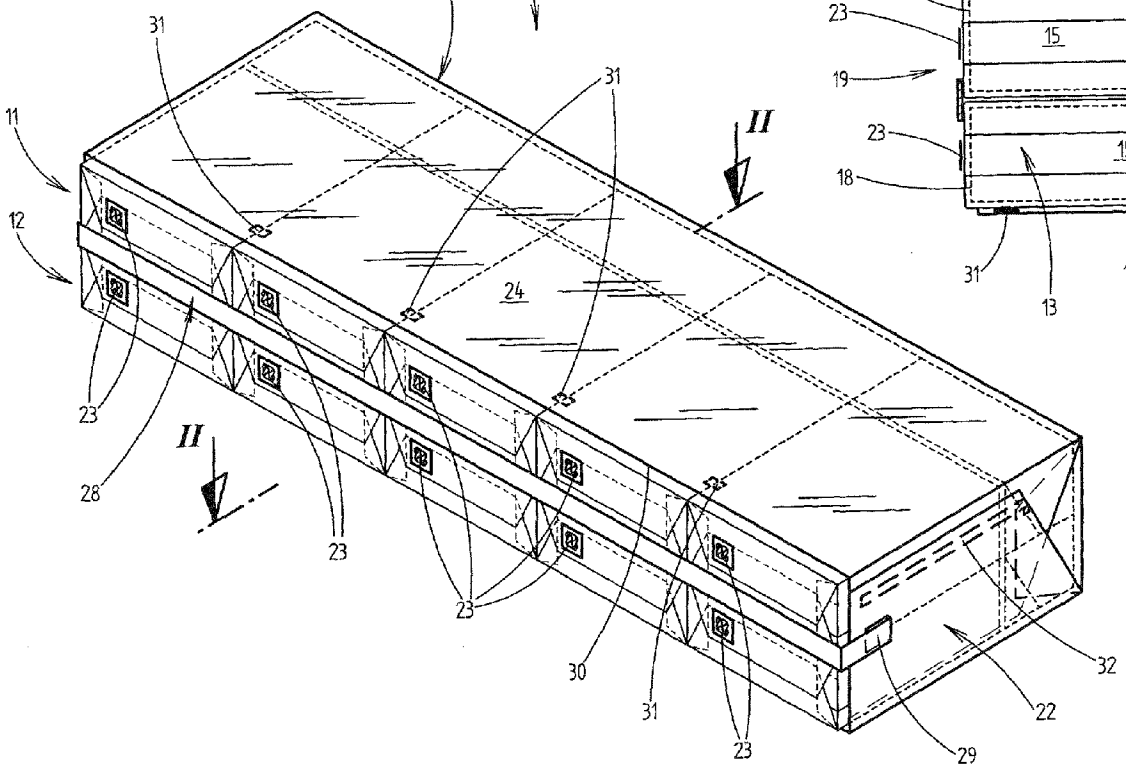
FIG. 1 shows a three-dimensional illustration of a multipack.
Figures 3, 4:
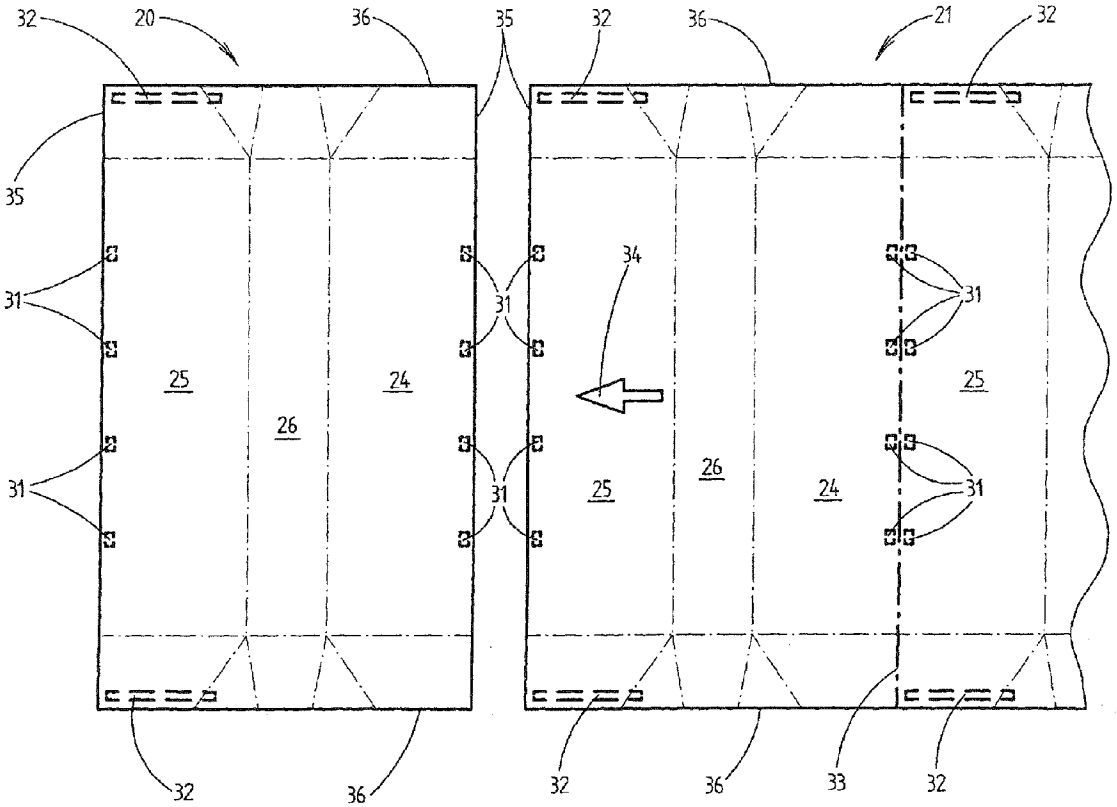
FIG. 3 shows a plan view of a blank for an outer wrapper of a multipack according to FIGS. 1 and 2.
FIG. 4 shows a plan view of a continuous material web for producing blanks according to FIG. 3.

As shown in FIG. 3, adjacent cigarette packs 13 within a row 11, 12 bear against one another via narrow side faces 15. Cigarette packs 13 in adjacent rows 11, 12 bear against one another via large front side faces 16 and rear side faces 17. All cigarette packs 13 within the multipack 10 are arranged with the same relative position so that all base side faces 18 are located in a common plane or on a common side of the multipack 10. In the present case, this is a base side 19 of the multipack 10.

The outer wrapper 14 consists of a blank 20, which is detached from a continuous material web 21.

The blank 20 for the outer wrapper 14 is conventionally wound around the formation formed of cigarette packs 13. Folding flaps of the blank 20 are normally folded in an envelope-like manner or are placed one on top of the other and are interconnected in the region of end faces 22 of the outer wrapper 14.

One feature of the multipack 10 or the blank 20 is that it is formed specifically for the application of tax markings 23 in the region of the base side 19 of the multipack 10. The blank 20 is dimensioned such that the base side faces 18 of the cigarette packs 13 are exposed, at least to such an extent that the tax markings 23 can be applied to the cigarette packs 13.

This may occur in such a way that the base side 19 is completely exposed and is not covered by the blank 20 or the outer wrapper 14. However, it may also be that the outer wrapper 14 extends slightly into the base side 19 of the multipack, in particular via a preferably peripheral edge region. In such a case, the base side 19 is substantially not covered by the outer wrapper 14 within the meaning of the present invention. However, as in the present case, it may also be that the outer wrapper 14 ends at a slight distance from the base side 19.

The blank 20 or the outer wrapper 14 is designed on the whole such that it sufficiently covers or surrounds the group of cigarette packs 13 as pack content on five sides of the multipack 10, namely in the region of mutually opposed end faces 22, a large-area front side 24, a rear side 25 opposite the front side, and a cover side 26 opposite the base side 19. The base side 19 is not covered by the outer wrapper 14, and therefore the cigarette packs 13 are exposed on their base side faces 18. A tax marking 23 can still be applied in the region of the base side faces 18 during production of the multipack 10 or preferably at a later point in time.

The tax markings 23 may be formed as seals, stickers, stamps or the like and are fastened accordingly to the cigarette packs 13.

Since cigarette packs 13 normally have a pack wrapper 27 made of film, the tax marking 23 can be fastened to the pack wrapper 27 by sealing.

Furthermore, a material strip 28 is provided, which stabilizes the cigarette packs 13 in the outer wrapper 14 and prevents the cigarette packs 13 from falling out from the outer wrapper 14. The material strip 28 is also used as a tear-off strip or tear-off strand for the multipack 10. For this purpose, an individual material strip 28 extends in the longitudinal direction of the multipack 10 specifically in the region between the two rows 11, 12 of the cigarette packs 13, wherein the material strip 28 is dimensioned in such a way that it covers edge regions of the cigarette packs 13 in both rows 11, 12.

The material strip 28 preferably consists of a packaging material. Production both from paper or (thin) cardboard is conceivable. The production of the material strip 28 from a film material is preferred however, as is known in the production of tear-off strips for multipacks 10.

The material strip 28 may be guided as far as the region of end faces 22 of the multipack 10. It is conceivable for the material strip 28 to extend as far as both adjacent end faces 22, as shown. It is also conceivable however for the material strip 28 to extend only as far as one end face 22 and to end at a short distance from the other end face 22.

The blank 20 for the outer wrapper 14 may also have a punched portion in the region of the free ends of the material strip 28, said punched portion possibly acting as a grip tab for the material strip 28. By engaging the grip tab in the blank 20, the corresponding free end of the material strip 28 can be engaged in order to open the multipack 10. Alternatively, a grip tab 29 may be formed by doubling over at least one free end of the material strip 28. This variant is shown in the FIGs.

The material strip 28 can be connected to the cigarette packs 13 and/or (only) to the blank 20 in the region of the end faces 24 of the multipack 10.

A particular feature of the multipack 10 may be that the outer wrapper 14 or the blank 20 is formed from or consists of paper, or is substantially formed from or substantially consists of paper. Neither a plastic film nor a cardboard are therefore used. Due to the use of paper instead of cardboard, the multipack 10 can be produced more cost effectively. The use of paper is also more environmentally friendly than the use of a plastic film.

It goes without saying that the outer wrapper 14 or the blank 20 does not have to consist completely of paper, but may also consist of a paper-based material and/or may have coatings made of other materials.

In order to increase the low inherent stability of the blank 20, said blank may have a reinforcement, which is arranged or designed such that it is located on the folded outer wrapper 14 in the region of the open base side 19 or surrounds said open base side 19. For example, a material reinforcement produced by doubling over an edge region or edge strip of the blank 20 (not shown) is conceivable. A free (lateral) edge 30 of the outer wrapper 14 or of the blank 20 can thus be reinforced.

A further particular feature of the multipack 10 may be that the cigarette packs 13 are detachably connected to the outer wrapper 14. The cigarette packs 13 are preferably connected to the outer wrapper 14 by glue portions. The glue portions are formed as glue points 31 in the exemplary embodiment shown, but may also have a different form.

On the one hand, an individual connection of each cigarette pack 13 to the outer wrapper 14 is conceivable. The connection illustrated in the FIGs. between each two adjacent cigarette packs 13 in the same row 11, 12 and the outer wrapper 14 is preferably produced by means of an individual (common) glue portion however. In this case, the glue portion is positioned or applied such that it is located in the region of a point of contact between two adjacent cigarette packs 13. On the one hand, a smaller number of glue portions are thus necessary than with an individual connection. On the other hand, at least one indirect connection between the adjacent cigarette packs 13 and the outer wrapper 14 is thus also produced via the connection in the region of the common glue portion. With a corresponding embodiment of the glue portions, a direct connection of adjacent cigarette packs 13 is also conceivable however. Irrespectively of this, it is also possible to apply the glue portion in the region of pack edges, because this region of the cigarette packs 13 is very stable and therefore enables a certain pressure when applying and/or activating the glue portions or when connecting the outer wrapper 14 to the cigarette packs 13.

Folding flaps of the blank 20 are folded in an envelope-like manner in the region of the end faces 22 of the multipack 10, wherein a glue strip 32 for connecting the folding flaps is used at each end face 22. In this case, the use of other glue portions, for example in the form of glue points, is also conceivable.

A further particular feature of the multipack 10 may be the selection of a specific glue for the glue portions (glue points 31 and/or glue strips 32).

A glue that enables a detachable connection of the cigarette packs 13 from the outer wrapper 14 is preferably used for the glue points 31 in order to connect the cigarette packs 13 to the outer wrapper 14. Such a glue is advantageous if the cigarette packs 13 are to be removed (individually) from the multipack 10 and in doing so have to be separated from the outer wrapper 14. In particular, a PSA glue (pressure sensitive adhesive glue) can be used in this region. The use of a conventional hot-melt glue is also conceivable however.

A hot-melt glue is preferably used in the region in which glue is to be applied to the folding flaps and produces a secure and durable connection of the folding flaps. The use of PSA glue is also conceivable in this instance.

It is also conceivable for a combination of conventional hot-melt glue and PSA glue to be applied to the blank 20. However, only one glue type is preferably used because this simplifies the construction of the corresponding application members. In this case, it is conceivable for example to apply a hot-melt glue in both regions. The corresponding purpose can then be taken into account by different temperatures during the reactivation process. For example, the reactivation temperature in the region of the folding flaps may deviate from the reactivation temperature in the region of the glue points 31 so as to create only an easily detachable connection in the region of the glue points 31 and a more secure connection in the region of the folding flaps.

The blank 20 (FIG. 3) is separated on a continuous material web 21 (FIG. 4) by a separating cut 33. In this case, the separating cut 33 is made transversely to the direction of transport 34 of the material web 21 in the region of a subsequent edge of the blank 20. FIG. 3 shows that the glue points 31 are each arranged at transverse edges 35 of the blank 20 (with respect to the direction of transport 34), whereas the glue strips 32 are arranged along longitudinal edges 36 of the blank 20. The separating cut 33 is made between two rows of glue points 31 on the material web 21.

It goes without saying that the particular features described above can each be used individually or in any combination. For example, the use of the glue portions or glue points 31 between the outer wrapper 14 and the packs 13 is thus also conceivable with outer wrappers 14 made of materials other than paper, for example with film outer wrappers 14.

Figure 5:
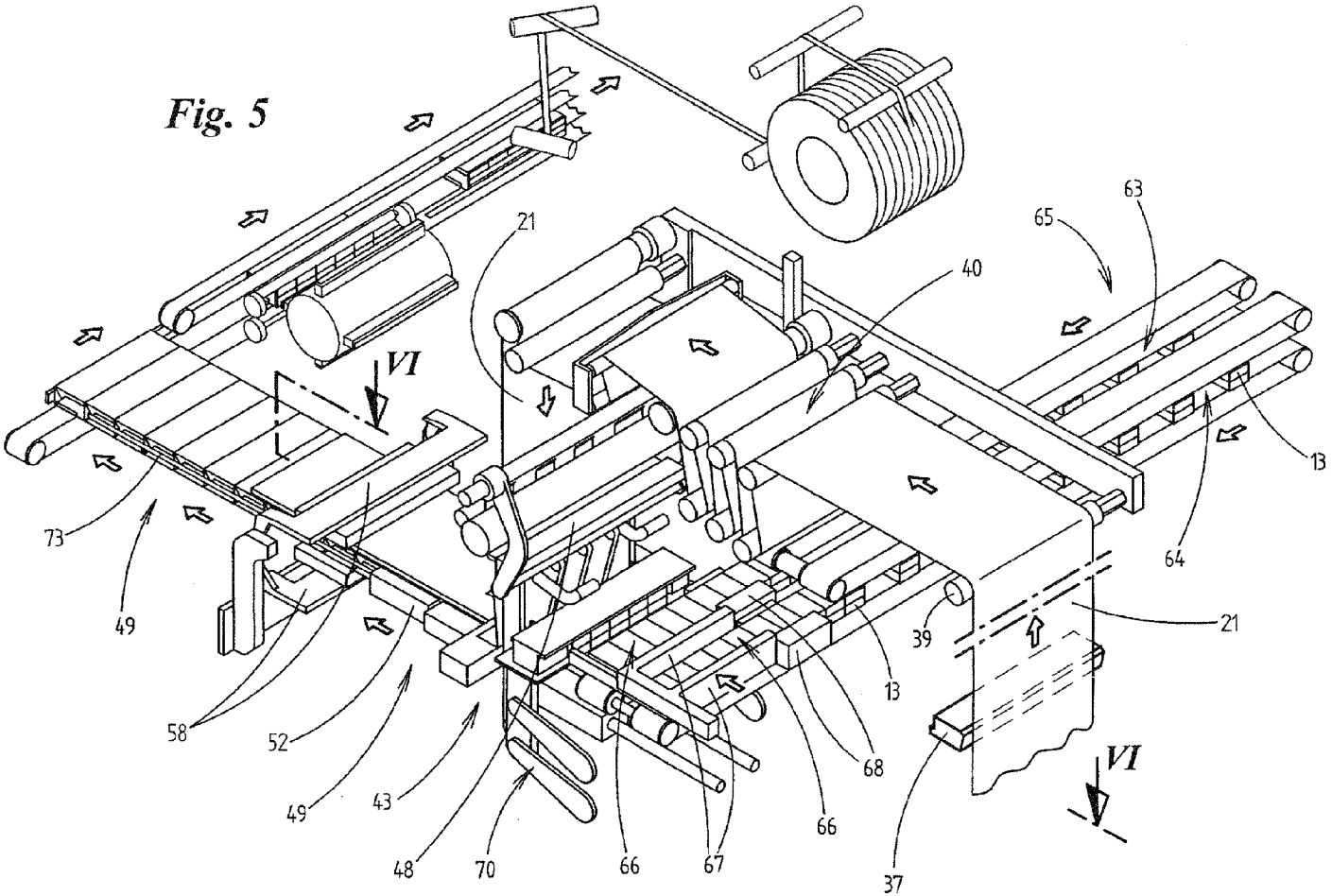
FIG. 5 shows a schematic three-dimensional illustration of an apparatus for producing multipacks.

FIG. 5 shows a schematic three-dimensional illustration of an apparatus for producing such a multipack 10. The individual regions of the apparatus will be described in detail hereinafter:

The continuous material web 21 for producing the blank 20 is first provided with glue in the region of a preferably vertical conveying path by means of a glue application device 37.

The glue application device 37 is arranged fixedly on one side of the material web 21. A pivotable press member 38, with the aid of which the material web 21 can be pressed against the glue application device 37 so as to transfer glue to the material web 21 as the material web 21 contacts the glue application device 37, is provided on the other side of the material web 21. If the production process is interrupted, the press member 38 can be pivoted away so that the material web 21 no longer bears against the glue application device 37 and is positioned freely between the glue application device 37 and the press member 38. Damage to the material web 21 caused by the glue application device 37, which may be heated, is thus avoided.

The glue application device 37 is preferably used to apply hot-melt glue, which is then reactivated later in the method. The glue application device 37 in this case applies the corresponding glue image according to FIGS. 3 and 4 to the material web 21. The glue application device 37 may also be formed however such that PSA glue is applied to the material web 21 or a combination of the two glue types.

Once glue has been applied to the material web 21, said material web is steered via a deflecting roller 39 into the region of a pendulum store 40. In the region of the pendulum store 40, the material web 21 is steered via further deflecting rollers 39, which are mounted in part on a pivotable pendulum arm 41. By pivoting the pendulum arm 41, the size of the pendulum store 40 can be changed.

Figure 7:
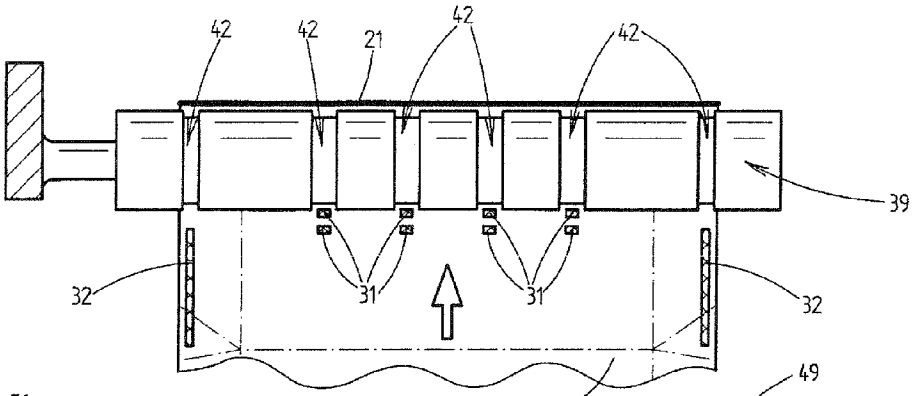
FIG. 7 shows a vertical section through the apparatus along the line of section VII-VII in FIG. 6.
Figure 8:
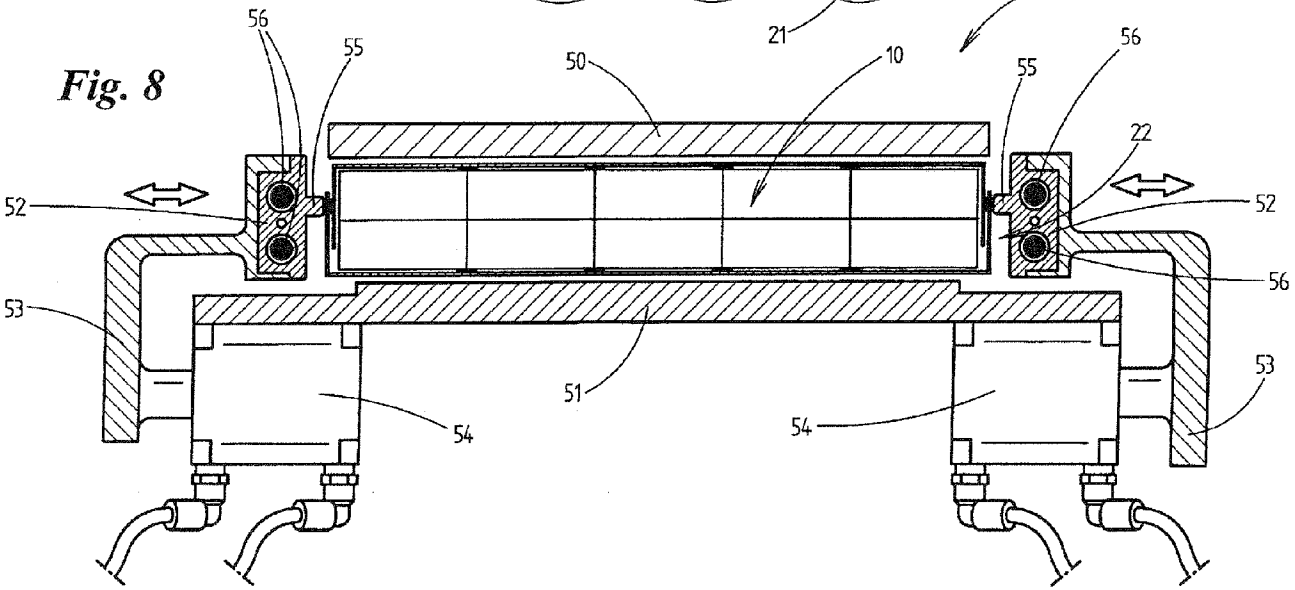
FIG. 8 shows a vertical section through the apparatus along the line of section VIII-VIII in FIG. 6.
Figure 9:
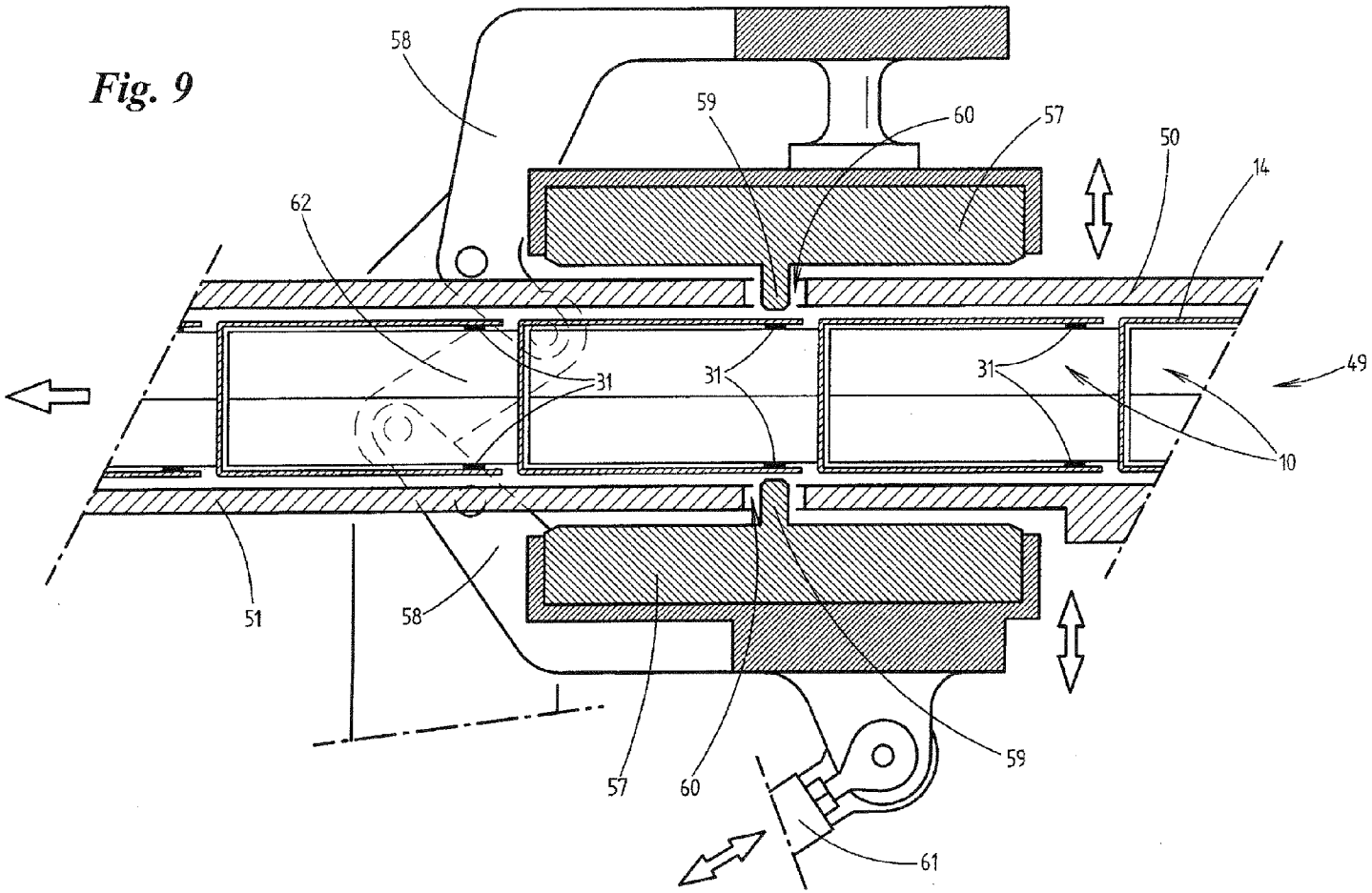
FIG. 9 shows an enlarged, partial illustration of a detail of the apparatus in the region IX in FIG. 6.

A particular feature of the deflecting roller 39 is shown in FIG. 7. According thereto, the deflecting roller 39 is provided with groove-shaped indentations 42, which are arranged continuously over the periphery of the deflecting roller 39 spaced laterally from one another. The indentations 42 are arranged such that glue points 31 and glue strips 32 on the material web 21 do not come into contact with the deflecting roller 39 when the material web 21 is deflected by the deflecting roller 39.

The width and depth of the indentations 42 is matched to the corresponding glue points 31 and glue strips 32. The width and depth of the indentations 42 is preferably constant over the periphery of the deflecting roller 39.

The indentations 42 in the deflecting roller 39 are particularly advantageous if the glue used is a PSA glue. The PSA glue can thus be prevented from being activated as a result of contact with the deflecting roller 39. The indentations 42 may also be advantageous however if the spacing between the glue application device 37 and the deflecting roller 39 is so small that the glue is not yet set when the portion of the material web 21 carrying the glue passes the deflecting roller 39.

It goes without saying that not all deflecting rollers 39 of the apparatus must have the described indentations 42. In particular when using conventional hot-melt glue, only the deflecting rollers 39 for example must have indentations 42, which are arranged at a critical spacing from the glue application device 37. By contrast, with the use of PSA glue, all deflecting rollers 39 should have corresponding indentations 42 passing the side of the material web 21 to which glue has been applied until the material web 21 is wound around the cigarette packs 13.

After the pendulum store 40, the material web 21 is deflected via a further deflecting roller 39 into a subsequent vertical conveying path and is conveyed along said path in the direction of a station 43 for winding a group of cigarette packs 13 in a blank 20 for the outer wrapper 14.

A pair of draw-in rollers 44, which transport the material web 21 as far as the region of a vacuum conveyor 45, is arranged along the conveying path. At the vacuum conveyor 45, the material web 21 is held in position by means of a vacuum and the separating cut 33 is made in a positionally accurate manner above the vacuum conveyor 45 by means of a cutting device 46, as indicated in FIG. 4. To this end, the cutting device 46 has a blade 48 arranged on a pivoting arm 47 for severing the material web 21. The blank 20 thus separated is then conveyed by means of the vacuum conveyor 45 as far as the region of the station 43 and is kept ready in order to be wound around a pack group.

In the station 43, the conveying path is intersected by a virtual pack path. At the point of intersection, a group of cigarette packs 13 forming the content of the multipack 10 is passed through the blank 20 kept ready and is slid into a conveying channel 49, the blank 20 being entrained and being folded in a U-shaped manner around the pack content.

The conveying channel 49 is defined on the upper side and lower side of the pack path by walls 50, 51, between which the pack content is conveyed with the blank 20. The conveying channel 49 is at least partially open to the side.

During the transport along the conveying channel 49, the folding flaps of the blank 20 are first folded in an envelope-like manner in the region of the end faces 22 of the outer wrapper. The glue points 31 and glue strips 32 are then activated in the region of the conveying channel 49 during a short standstill.

To activate the glue strips 32, heated members are preferably provided, which can be moved against the blank 20 or the outer wrapper 14 in the region of the end faces 22.

In the present case, the members are formed as heating jaws 52, which are each arranged to the side of the conveying channel 49 on supporting arms 53. The supporting arms 53 are in turn movable transversely to the direction of conveyance of the multipack 10 in the conveying channel 49 by means of (pneumatic or hydraulic) cylinders 54. The heating jaws 52 have a protrusion 55, which is moved against the end face 22 of the multipack 10 and is arranged in such a way that it corresponds with the position of the glue strips 32. "Heating cartridges" 56 for heating the heating jaws 52 are arranged in the heating jaws 52 so that the heating jaws 52 or the protrusions 55 can be heated in order to activate the glue strips 32 formed of hot-melt glue.

If hot-melt glue is not used, but instead PSA glue, it is possible to dispense with the heating of the heating jaws 52. Pressure is then exerted onto the glue strips 32 by means of the protrusion 55 or another surface of the member in order to activate the glue.

The glue points 31 are activated in a next step downstream of the conveying channel 49. In this case, heated members are preferably provided above and below the conveying channel 49 and can be moved in the region of the front side 24 and rear side 25 against the blank 20 or the outer wrapper 14.

The members are again formed as heating jaws 57, which are arranged on supporting arms 58 and have one or more protrusions 59 in order to activate the glue points 31. The heating jaws may again be assigned heating cartridges (not shown).

To activate the glue points 31, the walls, 50, 51 have recesses 60, through which the protrusions 59 can be passed in order to bear against the outer wrapper 14 of the multipack 10. Similarly to the activation of the glue strips 32 in the region of the end faces 22, it is possible to dispense with a heating of the members if the glue strips consist of PSA glue and can be activated by pressure.

The members are actuated in this station by means of a single cylinder 61, which is articulated at one of the two supporting arms 59. By coupling the two supporting arms 59 by means of a coupling member 62, the two supporting arms 59 can be actuated together by the cylinder 61.

The feed of the cigarette packs 13 and the transport of the pack groups along the conveying channel 49 will be described hereinafter:

The cigarette packs 13 are fed between mutually opposed conveying sides of pack conveyors 63, 64 in the region of a feed section 65. In this case, two cigarette packs 13 are in each case arranged flat one on top of the other and are transported at a distance from the next pair of cigarette packs 13. The two pack conveyors 63, 64 run parallel to one another with a small lateral spacing from one another. At the end of the pack conveyors 63, 64 or subsequently to the pack conveyors 63, 64, the cigarette packs 13 are backed up such that two parallel pack strands 66 consisting of cigarette packs 13 arranged one on top of the other are formed.

Figure 6:
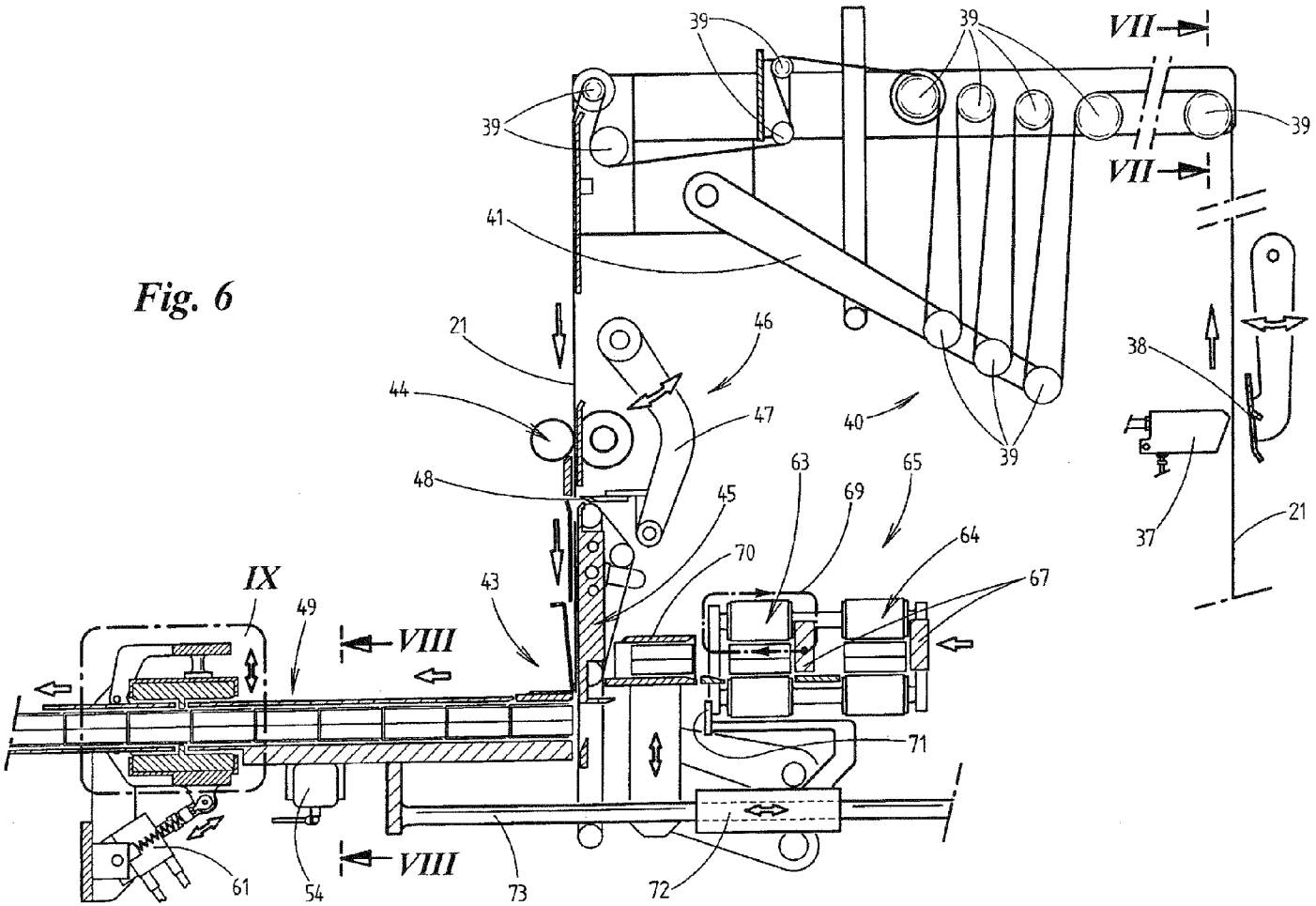
FIG. 6 shows a vertical section through the apparatus along the line of section VI-VI in FIG. 5.

Pack groups, which correspond to the content of a multipack 10, are pushed transversely from the two pack strands 66. Two coupled pushers 67 are used for this purpose. The pushers 67 each engage a respective pack group from the rear side and push it further in the direction of transport. Meanwhile, the foremost cigarette packs 13 of the pack strands 66 are prevented by pack brakes 68 from being pushed further by subsequent cigarette packs 13. The pack groups are pushed successively by the pushers 67 into a pack lift 70, which transports the respective pack group to the plane of the pack path in the region of the conveying channel 49 and then moves back into the plane to receive a next pack group. The movement path 69 of the pushers 67 is indicated in FIG. 6 for the pusher 67 arranged to the front in the direction of transport. In the plane of the pack path in the region of the conveying channel 49, the pack groups are engaged by a further pusher 71 and are pushed into the conveying channel 49, entraining a blank 20. The pusher 71 is in this case mounted on a slide 72, which can be displaced to and fro in the horizontal plane on a shaft.

After the members for activating the glue on the blanks 20, the conveying channel 49 is continued, wherein lateral guides 73 are provided in the region of the end faces 22 of the multipacks 10 in order to prevent the freshly bonded folding flaps of the blank 20 from springing open in this region. The freshly activated glue points 31 in the region of the front side 24 and the rear side 25 are prevented from springing open by the walls 50, 51 of the conveying channel 49.

Figure 10:
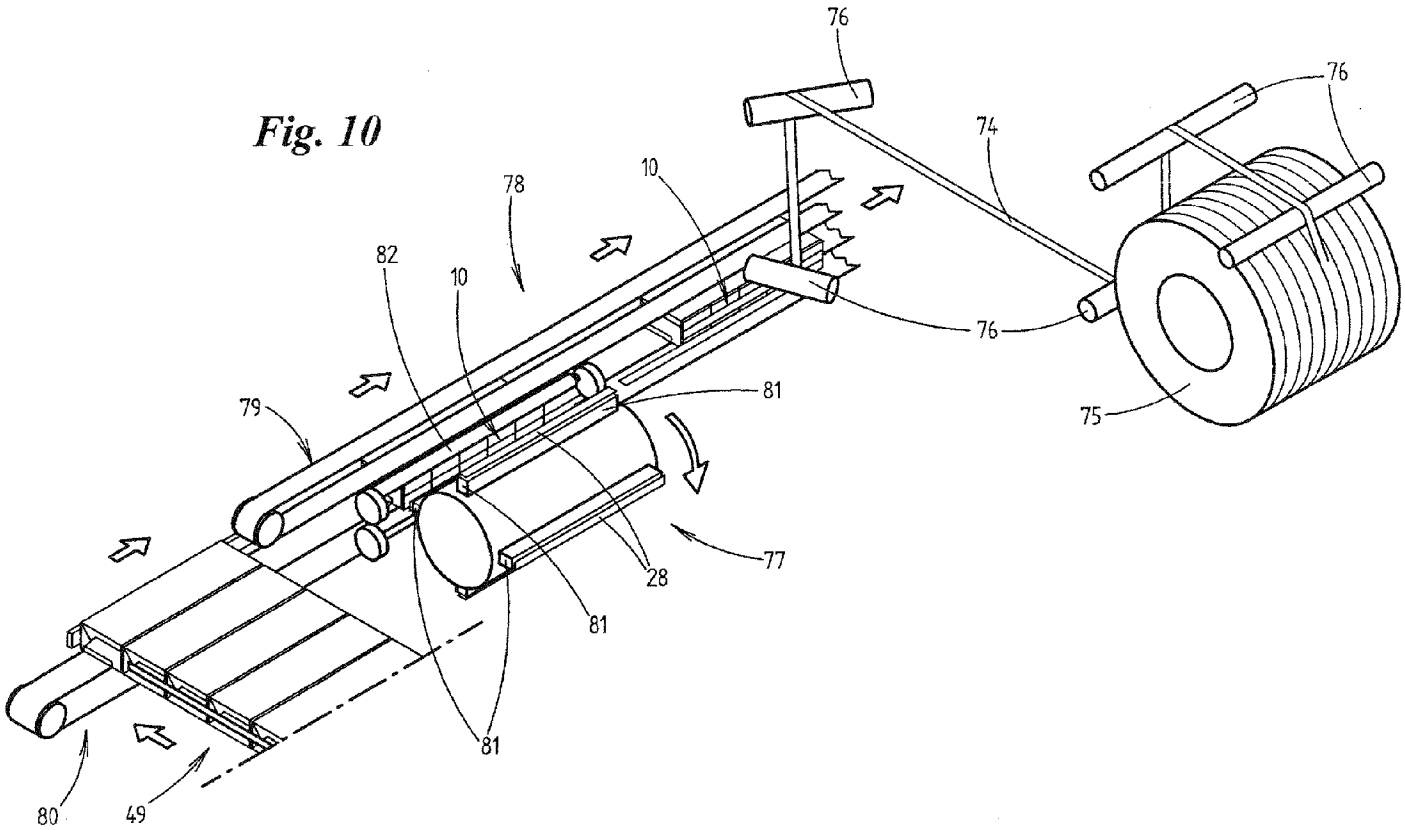
FIG. 10 shows an enlarged, partial illustration of a detail of the apparatus in the region of the application of material strips.

A further particular feature concerns the application of the material strip 28 to the multipack 10. This circumstance is shown in detail in FIG. 10. The material strip 28 is unwound as a continuous material web 74 from a bobbin 75 and is fed via deflecting rollers 76 to an application revolver 77 and is applied thereby to the multipacks 10.

The application revolver 77 is arranged adjacently to a push-off section 78, which adjoins the conveying channel 49 and preferably runs at an angle thereto, in particular transversely thereto. The push-off section 78 is formed in the present case by two pack conveyors 79, 80, wherein the multipacks 10 are transported between mutually opposed conveying sides of the pack conveyors 79, 80. The multipacks 10 are transported in the push-off section 78 with their longitudinal extension pointing in the direction of conveyance.

The application revolver 77 rotates about an axis (not shown), which is directed parallel to the direction of transport of the multipacks 10. A plurality of application members 81 each for receiving a material strip 28 separated from the material web 74 is provided over the periphery of the application revolver 77. The application members 81 are provided in the form of strip-shaped members over the periphery of the application revolver 77.

The multipacks 10 are pushed transversely from the conveying channel 49 by the pack conveyor 80, wherein the multipacks 10 rest against the pack conveyor 80 via their lower side. As soon as the multipacks 10 have left the conveying channel 49, they are engaged on the upper side by the pack conveyor 79 and are transported in the direction of the application revolver 77.

In the region of the application revolver 77, the material strip 28 separated from the material web 74 by suitable means is brought into contact with the base side 19 of the outer wrapper of the multipack 10 during a short standstill of the pack conveyors 79, 80. Due to the described transport of the multipacks 10, the base sides 19 point laterally in the direction of the application revolver 77. The material strips 28 are applied in the region of the base side 19 by means of a relative movement of the multipack 10 and application revolver 77 or application member 81 relative to one another.

The group formed of cigarette packs 13 is pressed together by two press elements 82 whilst the material strip 28 is applied in the region of the base side 19 and the adjoining end faces 22. The press elements 82 engage the multipack 10 in the region of the upper side and lower side thereof or in the region of the front side 24 and rear side 25 of the outer wrapper 14, namely in an edge region via which the multipack 10 protrudes laterally from the pack conveyors 79, 80. The cigarette packs 13 in the two rows 11, 12 are thus pressed against one another and the material strip 28 is applied in a positionally accurate manner.

LIST OF REFERENCE NUMERALS

10 multipack
11 row
12 row
13 pack
14 outer wrapper
15 narrow side face (pack)
16 front side face (pack)
17 rear side face (pack)
18 base side face (pack)
19 base side (outer wrapper)
20 blank
21 material web
22 end face (outer wrapper)
23 tax marking
24 front side (outer wrapper)
25 rear side (outer wrapper)
26 top side (outer wrapper)
27 pack wrapper
28 material strip
29 grip tab
30 edge
31 glue point
32 glue strip
33 separating cut
34 direction of transport
35 transverse edge
36 longitudinal edge
37 glue application device
38 press member
39 deflecting roller
40 pendulum store
41 pendulum arm
42 indentation
43 station
44 draw-in roller
45 vacuum conveyor
46 cutting device
47 cutting arm
48 blade
49 conveying channel
50 wall
51 wall
52 heating jaw
53 supporting arm
54 cylinder
55 protrusion
56 heating cartridge
57 heating jaw
58 supporting arm
59 protrusion
60 recess

61 cylinder
62 coupling member
63 pack conveyor
64 pack conveyor
65 feed station
66 pack section
67 pusher
68 pack brake
69 movement path
70 pack lift
71 pusher
72 slide
73 lateral guide
74 material web
75 bobbin
76 deflecting roller
77 application revolver
78 push-off section
79 pack conveyor
80 pack conveyor
81 application member
82 press element

What is claimed is:

1. A multipack having a plurality of cuboidal packs (13), that are partially surrounded by an outer wrapper (14) made of packaging material, wherein the packs (13) are to be provided with revenue stamps (23), and wherein the outer wrapper (14) does not extend over regions of the packs (13) at which the revenue stamps (23) are to be attached to corresponding pack faces of the packs (13), and wherein the outer wrapper (14) is connected releasably to the packs (13) via spots of glue (31), wherein each of the spots of glue (31) connect the outer wrapper (14) to two adjacent said packs (13), wherein each said spot of glue (31) extends over adjacent pack edges of two mutually facing sides of the two adjacent said packs (13).

2. The multipack according to claim 1, wherein the spots of glue (31) are arranged between the outer wrapper (14) and large-area pack faces of the packs (13).

3. The multipack according to claim 2, wherein the spots of glue (31) are arranged at a short distance from a free periphery (30) of the outer wrapper (14).

4. The multipack according to claim 1, further comprising the use of one of hot-melt glue and a pressure sensitive adhesive glue for the spots of glue (31).

5. The multipack according to claim 1, wherein folding flaps of the outer wrapper (14) are connected by means of strips of glue (32), wherein the strips of glue (32) and the spots of glue (31) consist of hot-melt glue, and wherein the strips of glue (32) and the spots of glue (31) are activated at different temperatures in order to achieve bonded connections of different strengths.

6. The multipack according to claim 1, wherein the outer wrapper (14) is formed from paper or is formed substantially from paper.

7. The multipack according to claim 6, wherein a free periphery of the outer wrapper (14) is reinforced by means located next to a base side (19) of the multipack (10).

8. The multipack according to claim 7, wherein the reinforced free periphery means of the outer wrapper (14) is a peripheral region of the outer wrapper (14) being folded back.

9. The multipack according to claim 1, wherein the packs (13) are secured against falling out of the multipack (10), in the region of a side face of the multipack (10) that is not wrapped or is not substantially wrapped by the outer wrapper (14), by a strip of material (28) made of packaging material, such that the strip of material (28) covers peripheral regions of packs (13) of adjacent rows (11, 12) of the packs (13) within the multipack (10) and is fastened to the packs (13), specifically such that the strip of material (28) extends in the longitudinal direction along a base side (19) of the multipack (10) between two adjacent rows (11, 12) of the packs (13) and covers the peripheral regions thereof and is connected to the packs (13) or the pack wrappers (27) thereof.

10. The multipack according to claim 9, wherein the strip of material (28) extends into the region of an end side (22) of the multipack (10), adjoining the base side (19), and is connected to the outer wrapper (14) there.

* * * * *